United States Patent [19]

Kajihara et al.

[11] 4,361,315

[45] Nov. 30, 1982

[54] SONDE APPARATUS FOR BLAST FURNACE

[75] Inventors: Toyota Kajihara; Atsushi Kawasaki; Fujikazu Nishio, all of Ohita; Akira Esaki, Kitakyushu, all of Japan

[73] Assignee: Nippon Steel Corporation, Tokyo, Japan

[21] Appl. No.: 213,733

[22] Filed: Dec. 5, 1980

[30] Foreign Application Priority Data

Dec. 21, 1979 [JP] Japan ..... 54-165690

[51] Int. Cl.[3] ..... C21B 7/12

[52] U.S. Cl. ..... 266/99; 266/80; 266/87; 266/226

[58] Field of Search ..... 266/99, 80, 86, 87, 266/89, 225, 226

[56] References Cited

U.S. PATENT DOCUMENTS 3,632,100 1/1972 Schneider ..... 266/99

FOREIGN PATENT DOCUMENTS 53-99006 8/1978 Japan ..... 266/99

*Primary Examiner*—M. J. Andrews

*Attorney, Agent, or Firm*—Wenderoth, Lind & Ponack

[57] ABSTRACT

Sonde apparatus for a blast furnace whose wall is provided with a lance ingress and egress port through which a lance is able to enter into the furnace and withdraw therefrom wherein a gas check valve, lance cutting means, lance cooling means, lance straightening means, and gas seal means are provided in succession and in communication with one another, and drive means for inserting and withdrawing the lance is further provided in succession therewith, all said elements being arranged along a line which is an extension of the axis of the lance ingress and egress port.

3 Claims, 16 Drawing Figures

FIG. 3-a
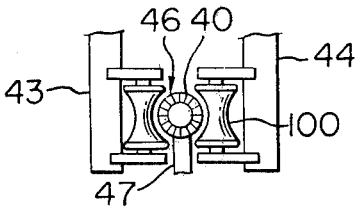
FIG. 4
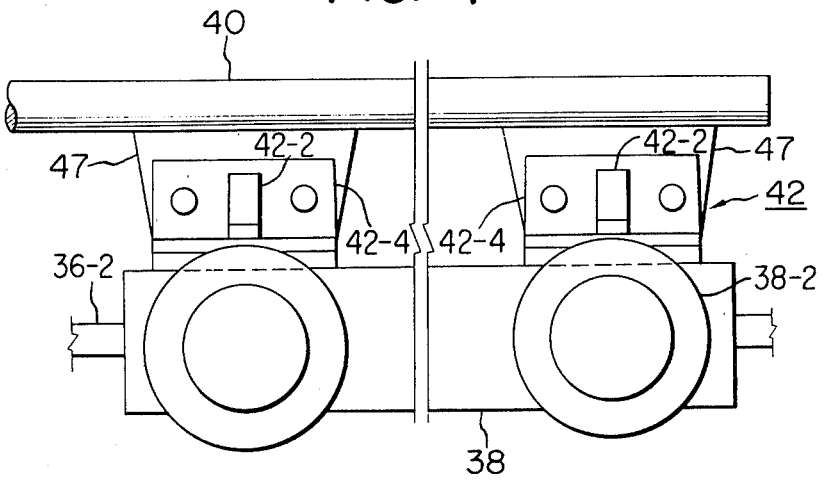
FIG. 5
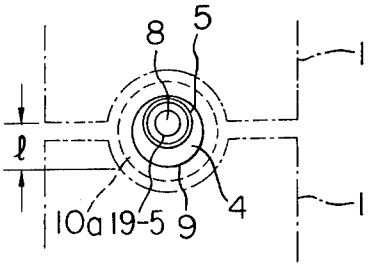

SONDE APPARATUS FOR BLAST FURNACE

BACKGROUND OF THE INVENTION

A. Field of the Invention

The present invention relates to a sonde or detecting apparatus for a blast furnace, and more particularly, to a train of devices for inserting and withdrawing a lance into and from a blast furnace and other ancillary means for detecting the conditions in the blast furnace. The term "sonde apparatus" as used in connection with the invention refers to an apparatus for inserting and withdrawing a lance into and from a blast furnace for detecting the conditions in the furnace.

B. Description of the Prior Art

As is well known, a blast furnace is an independent metallurgical reactor. It is, however, difficult to clearly determine the phenomena occurring in the furnace. It has been considered to be very significant for the stable operation of the blast furnace to grasp and understand the charging of materials by the known bell and cup system of the prior art and the situation how the charge materials and hot blast blown from the tuyere are distributed. In this connection, it has recently become increasingly important to know the gas constituents in the furnace, the temperature of the gas, and the tendencies in the cohesive zone (softening and melting zone) of the furnace. The horizontal sonde apparatus has been developed to obtain this information.

For instance, in Japanese Laid-Open Patent Application No.99006 (1978), it is proposed that a horizontal sonde apparatus comprising a successive arrangement of a gas seal means and a curved distortion straightening means be provided on the steel shell of the blast furnace.

The horizontal sonde apparatus disclosed in this laid-open patent application has a defect in that it is susceptible to leakage of blast furnace gas. This is because the sonde apparatus makes no allowance for the bending of the lance inserted into the blast furnace. The apparatus which guides the bent lance when it is withdrawn also serves as the gas seal means and is therefore not able to absorb the bend in the lance. As a result, the seal which should properly be tightly engaged with the periphery of the lance is easily damaged, giving rise to leakage of the blast furnace gas.

Moreover, after having served its purpose in the blast furnace, the lance is withdrawn in the high temperature condition and passed through the bend straightening means where it is subjected to hot straightening. However, a fresh bend occurs in the once-straightened lance in the radiating-and-cooling step. As a result, the reuse of the lance is impossible or very difficult. That is to say, though it may be possible to insert the lance into the furnace again, insertion as far as the specified position is very difficult. Furthermore, the seal packing of the gas seal disposed at the forward end will be damaged by burning due to the heat of the lance withdrawn at the high temperature.

Furthermore, the lance is generally of an extended length and it is very difficult to insert and withdraw a long lance into and from the furnace using the arrangement described above. The lance of the prior art has other disadvantages as well. For example, it is apt to buckle when it is inserted into the furnace.

SUMMARY OF THE INVENTION

The inventors made an extensive study of safe and reliable ways to determine the conditions of a blast furnace. As a result of their study, they have developed a simple sonde apparatus for provision on the shaft of the blast furnace. Their sonde apparatus is constituted of a train of devices for inserting and extracting a lance of a small diameter.

Accordingly, it is a principal object of the present invention to provide a sonde apparatus for actual measurement of the conditions existing in a blast furnace.

It is another object of the invention to provide a sonde apparatus which makes it possible to measure the actual conditions in a blast furnace by providing an apparatus for inserting and withdrawing a lance directly through an opening in the furnace wall, and furthermore, a train of devices for inserting and withdrawing a lance of a small diameter having an extended length along a straight line passing through said devices.

BRIEF DESCRIPTION OF THE DRAWINGS

Other and further objects of the invention will be better understood from the following detailed description with reference to the accompanying drawings in which:

FIG. 3-*a* is a sectional view of another embodiment different in one of its elements from that of FIG. 3;

FIG. 4 is a sectional view along the line C—C of FIG. 2;

FIG. 5 is a sectional view along the line A—A of FIG. 1;

DETAILED DESCRIPTION OF THE INVENTION

The present invention will be described in detail with reference to the drawings.

Figure 1:
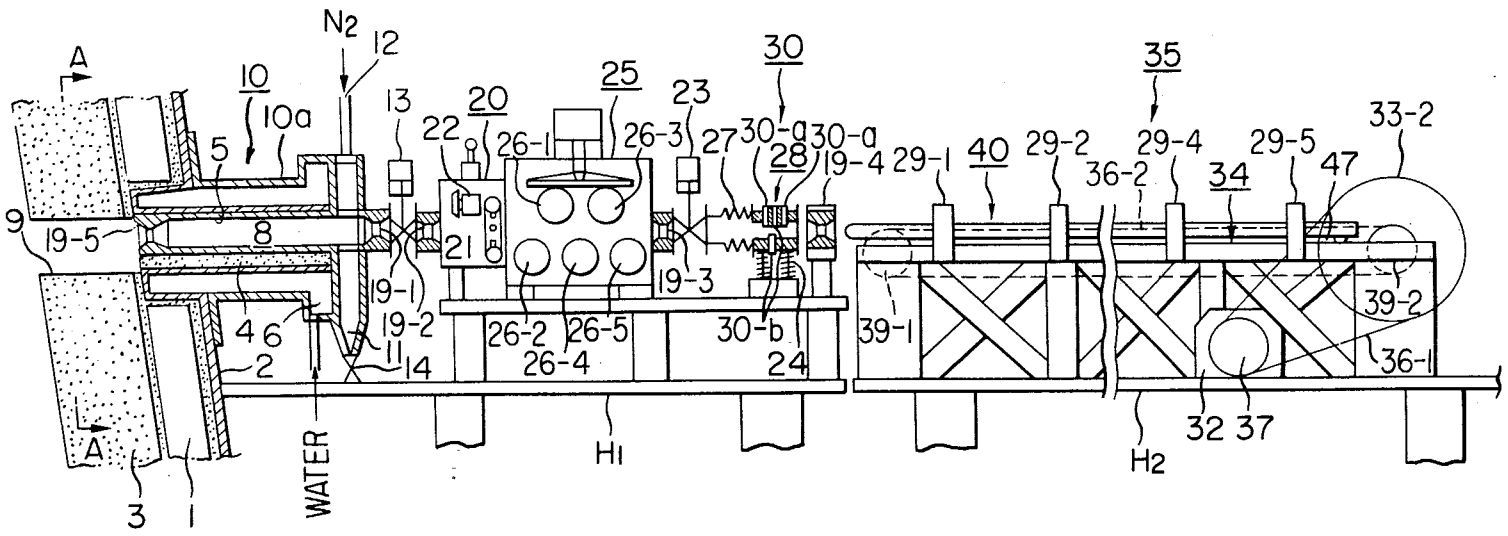
FIG. 1 is an explanatory front view of the whole apparatus according to the present invention.

The sonde according to this invention is not particularly limited in how or where it is applied, but it is preferably provided at the bosh, shaft, etc. of the blast furnace in a horizontal state. As seen in FIG. 1, the refractory lining 3 and stave cooler 1 of the blast furnace are protected by a steel shell 2. A lance ingress and egress port apparatus 10 through which the insertion and extraction of a lance according to this invention is accomplished is provided directly opposite an opening 9 in the furnace wall.

The lance ingress and egress port apparatus 10 comprises a lance ingress and egress port 8, a cooling apparatus 10*a* consisting of a surrounding cooling section 6 and/or an $N_2$ gas blowing inlet 12 for preventing furnace gas and dust from counterflowing into the lance ingress and egress port 8, a dust vent 11, castable entrance 4 which protects the ingress and egress port 8, a metal guide member 5, and a metal lance guide member 19-5 in the form of a Venturi tube throttle installed around the end of the lance ingress and egress port 8 within the furnace.

FIG. 5 is a sectional view taken along line A—A of FIG. 1 showing how the cooling apparatus is provided in such a manner that the lance ingress and egress port 8 is eccentrically disposed at an upward location on the blast furnace relative to the opening 9. The metal lance guide member 19-5 is installed around the end of the lance ingress and egress port 8 within the furnace.

Returning to FIG. 1, a lance straightening means 25 according to this invention is provided outside the furnace on an extension of the axis of the lance ingress and egress port apparatus 10. A gas cut-off valve 13 is provided between the apparatus 10 and the straightening means 25. Besides, as occasion demands, there is provided a closed box 20 accommodating a lance cutting means 22 and a lance cooling means 21.

The lance cooling means 21 need not necessarily be provided when the object is to measure conditions (gas temperature, composition, pressure, etc.) at a low temperature zone of the blast furnace, namely, at the upper part of the furnace near the stock line. On the contrary, it is preferable to provide this apparatus for measuring conditions at a high temperature zone of the blast furnace, namely, at the lower part of the shaft thereof, where the temperature ranges from about 300° C. at the furnace wall to about 1200° C. at the furnace center.

In addition, when the pushing and pulling force of the drive mechanism for the lance insertion and extraction 35 described hereinafter is strong or a lance of a large diameter is used, the lance cutting means 22 is not absolutely necessary. However, when the pushing and pulling force of the lance drive mechanism is weak or a lance of a small diameter is used, the lance cutting apparatus is preferably installed.

The length of the small diameter lance used in this invention depends upon the volume of the blast furnace. In order for it to reach the center of a super-large blast furnace with a volume of 5000 $m^3$, for example, its overall length will be as long as 14 m.

The inventors have discovered through their experiments that during the extraction of a lance 40 which has been bent in the furnace, if the lance is first straightened by the straightening means 25 prior to being passed through a gas seal 30, damage to the gas seal packing of the gas seal 30 can be prevented and at the same time the reuse of the lance 40 and the retrieval of a sample from the charge material in the furnace can be assured. They also found that the lance straightening effect is better if the lance is cooled by a cooling means 21 before it is leveled.

Because of this, in this invention, the lance cooling means 21, the lance straightening means 25 and the gas seal means 30 are arranged in the order mentioned following the gas cut-off valve 13 along an extension arranged outwardly from the furnace on the axis of the lance ingress and egress port 8 of the lance ingress and egress port apparatus 10.

In this invention, the lance cutting means 22, which is of the rotary saw type and can be freely raised and lowered, can, as required, be provided in front of the lance cooling means 21.

In a case where the lance 40 is so badly bent by slip channeling or some other unexpected change within the furnace such that its withdrawal during operation of the furnace becomes impossible, the lance is cut off and the remaining part is pulled out. A secondary cut-off valve 23 is then wholly closed so that the operation can be continued safely.

The lance straightening means 25 having a plurality of rolls 26-1–26-5 arranged in a staggered relationship is disposed next to and in communication with the lance cooling means 21. The straightening effect of the straightening means 25 is further enhanced by the provision of a side roll (not shown) near the lance entrance.

The gas seal 30 located behind and in communication with the lance straightening means 25 has an expansion tube 27, and its seal section 28 is provided with a packing gland to assure a tight, slidable engagement with the outer peripheral wall. The seal section 28 and the lance straightening means 25 are disposed on a common axis with the secondary cut-off valve 23 therebetween. The gas seal 30 is supported by springs 24 attached to the seal section 28.

Even after the lance 40 has passed through the lance straightening means 25, it still has a very slight bend on the order of 3–5 mm per meter. Therefore, the gas seal 30 is made freely movable so as to be able to adjust its position in response to any bend in the lance. This is effective both in protecting the gas seal 30 during insertion of the lance and in providing a better seal against blast furnace gas making its way through the train of devices disposed ahead of the gas seal 30.

The seal section 28 of the gas seal is provided with a coolant inlet 31-*a* which can take for instance gas, mist, liquid, or steam as a coolant, and seal section 28 is also provided with a lubricant inlet 30-*b*.

The closed box 20, the lance straightening means 25, and the gas seal 30 are provided on a furnace frame $H_1$ secured to the steel shell 2 of the blast furnace, and the height and position of the frame preferably follow the changes in height and position of the steel shell 2 of the furnace due to thermal expansion.

Figure 2:
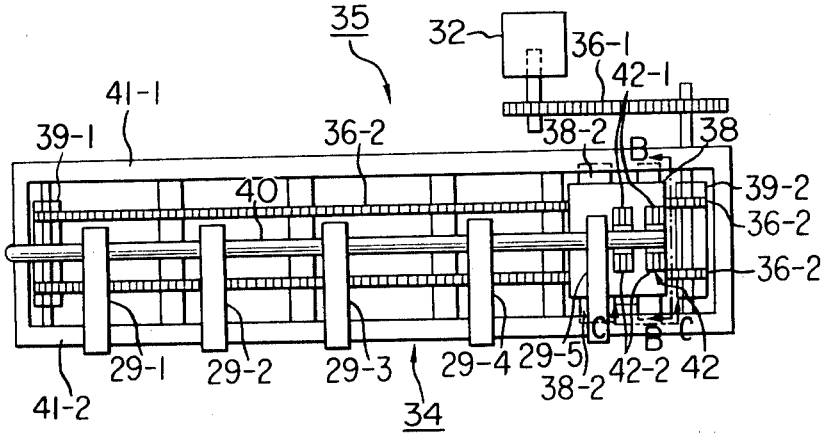
FIG. 2 is a partial plan view of the apparatus according to the invention.

As best seen in FIG. 2, the lance ingress and egress drive apparatus 35 comprises a chain drive means 39 disposed on a running frame 34, a plurality of buckling prevention arms 29-1–29-5 which slidably hold the lance, a drive means 32 for the chain drive means 39, and a lance carriage 38. The lance carriage 38 supports the rear end of the lance 40 and is connected to a chain 36-2 of the chain drive means 39, and moves on the running frame 34 so as to insert and extract the lance 40 into and from the furnace via the path formed by the train of devices described above.

The spacing of the buckling prevention arms 29-1–29-5 is not particularly critical, and, for instance, in the case of a small diameter lance, the buckling prevention arms 29-1–29-5 may be disposed at intervals of about 1500 mm in the longitudinal direction of the running frame 34. In FIG. 1, the lance quide members 19-2, 19-3, and 19-4 are the same as the lance guide member 19-1, and are provided to both assure that the lance follows a straight path and to reduce friction during inward and outward movement of the lance.

Figure 3:
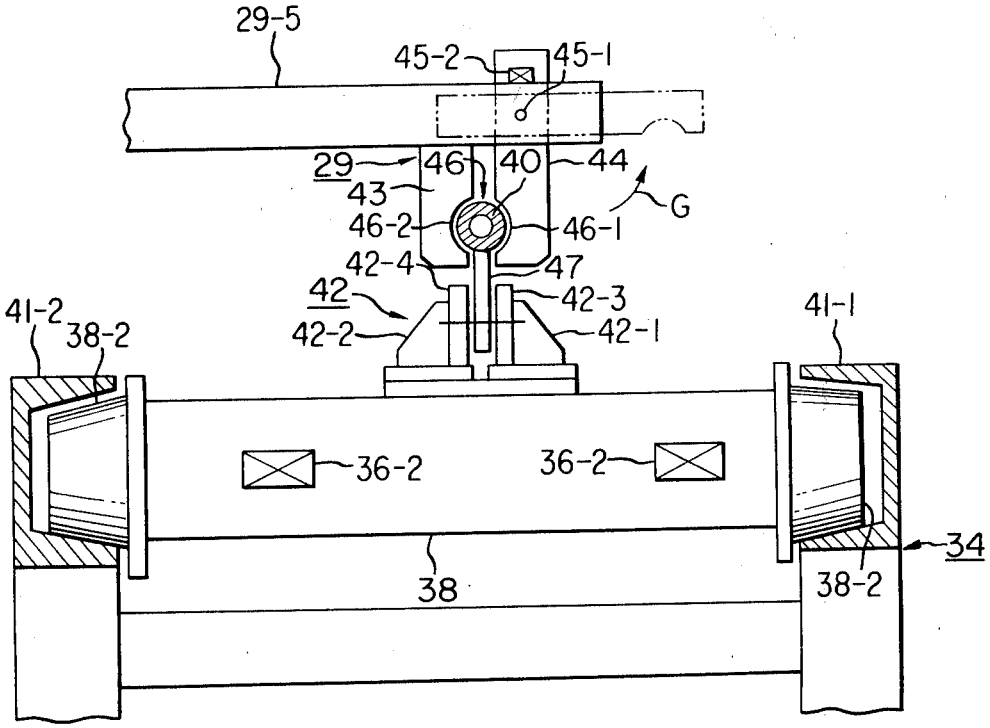
FIG. 3 is a sectional view taken along the line B—B of FIG. 2.

The length of the lance can be suitably determined in accordance with the volume of the furnace. However, in handling a small diameter lance with a diameter of about 30 mm level and a length of up to 14 m, it is very important to prevent the lance from buckling. To this end, the lance ingress and egress drive apparatus 35 is provided with a suitable number of lance buckling prevention arms 29-1–29-5 on the running frame 34. The arms 29-1–29-5 are, out of design considerations, disposed perpendicularly to the running direction of the lance carriage 38. The wheels 38-2 on either side of the lance carriage are engaged with U-shaped guide rails 41-1–41-2 on the running frame 34 as shown in FIG. 3. The lance carriage 38 is connected to the chain 36-2 extending between chain wheels 39-1 and 39-2 and is driven to run in the direction of the furnace center by the drive means 32. Namely, the chain 36-2 between the wheel 39-2 disposed on the shaft of a sprocket 33-2 and the wheel 39-1 gets its drive force from the drive means 32 via the wheel 37, the chain 36-1 and the sprocket 33-2.

FIG. 3 is a sectional front view taken along the line B—B of FIG. 2, and FIG. 4 is a sectional side view taken along the line C—C of FIG. 2.

As shown in FIG. 3, each buckling prevention arm 29 comprises a hanging lance clamp body 43 and a hanging movable clamp body 44 facing each other to form a lance holder 46 having an open lower end. The lance clamp bodies 43 and 44 are provided with semicircular notches 46-1 and 46-2 or guide-rolls 100 shown in FIG. 3-*a* facing each other. Buckling preventing arms 29-1–29-5 each have the semicircular notches 46-1 and 46-2.

As shown by an arrow G in FIG. 3, the movable clamp body 44 can be opened and closed by being rotated by an angle of 90° about the axis 45-1. Hence, the small diameter lance 40 can be freely clamped by and released from the buckling prevention arm. Furthermore, the lance 40 is so held that the main body thereof and a bracket 47 (FIG. 4) which supports the rear end of the lance are able to run freely. The movable clamp body 44 can be secured in place or be freed to rotate by engaging or disengaging a lock 45-2.

The bracket 47 is provided on the long, small-diameter lance and is detachably connected to the lance retainer 42. The retainer 42 comprises holders 42-3 and 42-4 and reinforcing members 42-1 and 42-2 which secure the holders 42-2 and 42-4 to the carriage 38.

Accordingly, the long, small-diameter lance can be run and moved by the lance carriage 38 as the lance is guided by a plurality of lance holders 46 each consisting of a pair of lance clamp bodies 43, 44. Hence, the lance 40 can be smoothly and safely be driven straight forward into the blast furnace without bending of buckling.

However, when the long, small-diameter lance 40 is inserted into the blast furnace and exposed to high temperature during its operation as a detector, downward bending of the inserted parts of the lance 40 inserted into the furnace is inevitable.

However, as shown in FIG. 5, because of the amount of eccentricity l provided between the lance ingress and egress port 8 of the ingress and egress port apparatus 10 and the opening 9, the bent lance 40 can be withdrawn from the furnace without being damaged by the corner of the opening 9 and without damage to the refractory brick surrounding the opening 9.

Furthermore, since the lance 40 is supported by the metal lance guide member 19-5 and at at least two other points by the other lance guide members 19-1 and 19-4, it can be operated with complete safety.

In the present invention constituted as described above, the lance ingress and egress port apparatus 10 is provided on the wall of the blast furnace, and the lance cooling means 21, the lance straightening means 25 and the gas seal 30 are mounted on the furnace frame $H_1$ secured to the steel shell 2 of the blast furnace. Moreover, the lance ingress and egress drive apparatus 35 is provided on a frame $H_2$ separate from the frame $H_1$ of the above train of devices and so as to allow the devices on the frame $H_1$ to move in accordance with variation in height and position resulting from thermal expansion of the steel shell 2. Thus, the train of devices which form the ingress and egress path of the lance 40 between the guide 19-4 and the lance ingress and egress port apparatus 10 can be prevented from going out of alignment.

Besides, since the long lance 40 can be sufficiently straightened for all practical purposes, a multi-purpose lance or various kinds of special purpose lances can be used without regard to the frequency of use. Changing of lances is also made easy. As a result, in accordance with this invention, the conditions in the furnace can be reliably detected and stable operation of the blast furnace can be maintained. The invention thus makes a considerable contribution to industry.

The lance used in this invention will be described below.

Figure 6:
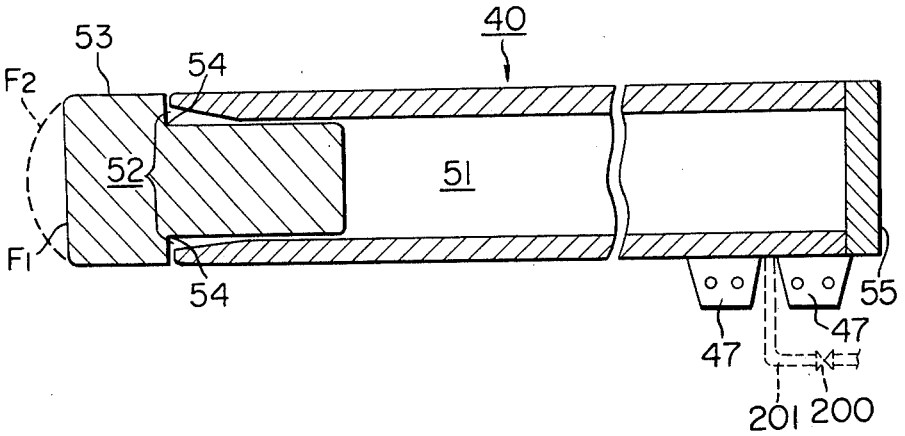
FIG. 6 is a partially sectional view of a sampling lance used in the invention.

As shown in FIG. 6, the lance 40 has an open forward end 52 which serves as an inlet for introducing the charge material into an internal chamber 51 while its rear end is closed by a lid 53. The bottom rear of the lance 40 is provided with the bracket 47 for connecting the lance 40 to the lance carriage 38. At the forward end of the lance 40 is a lid 53 having a stepped portion 54 with a smaller diameter than the inner diameter of the lance 40. The forward end of the lid 53 has the same outside diameter as the lance 40 and is formed either into a flat head $F_1$ or into a hemispherical head $F_2$ as shown by a dotted line in the figure. The lid 53 fits detachably into the lance 40.

When the charge material of the blast furnace is to be sampled, the lance 40 is connected to the lance carriage 38 via the bracket 47. Next, the lance carriage 38 is driven forward to insert the lance 40 through the lance ingress and egress port 8 provided in the wall of the blast furnace into the layers of charge material in the furnace.

As the forward tip of the lid 53 is not pointed but is formed as a flat head $F_1$ or a hemispherical head $F_2$, it does not seek out the path of least resistance as it progresses into the charge material in the blast furnace but continues straight ahead almost unaffected by differences in the resistance offered by the material it passes through.

Subsequently, the lance carriage 38 is driven in the reverse direction to cause the lid 53 to withdraw from the lance and then stops the lance at the position where the charge material is to be sampled. Then, the lance carriage 38 is again driven in the forward direction to fill the internal chamber 51 with the charge material through the inlet 52.

When the chamber 51 is full, the lance carriage 38 is driven in the reverse direction to pull the lance 40 out of the furnace so that the charge material can be removed from the inner chamber 51.

As shown by the dotted line in FIG. 6, the rear of the lance 40 is connected to a pipe 201 provided with a valve 200.

In pulling the lance 40 out from the furnace, it is preferable to purge the chamber 51 with $N_2$ so as to prevent oxidation of the charge material in the inner chamber 51. This is done by opening the valve 200.

Figure 7:
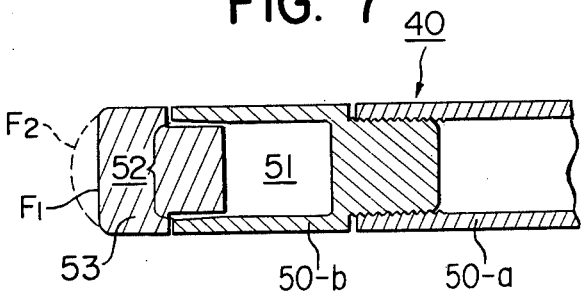
FIG. 7 and FIG. 7-*a* are sectional views of another embodiment different from that of FIG. 6.
Figure 7:
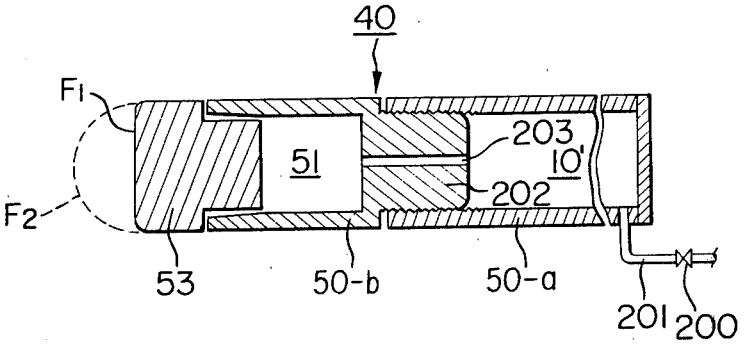

FIG. 7 shows another embodiment of a lance in accordance with the present invention. In this embodiment, the forward end of the lance **50-*b* including the inner chamber 51 is so provided that it can be disengaged from the base 50-*a*** of the lance.

With this construction, after the lance has been withdrawn from the furnace, the open forward end 52 of the forward end **50-*b* of the lance 40** through which the charge material is introduced is closed by a sealing lid (not shown) in order to protect the charge material from oxidation while it is being cooled. Otherwise, as shown in FIG. 7*a*, the plug 202 of the forward end **50-*b* of the lance is provided with one or more apertures 203 and $N_2$ gas is introduced through the apertures from the pipe 201 connected to the base 50-*a* of the lance via the valve 200. The inner chamber 51** containing the charge material is thus filled with $N_2$ gas so as to obtain an analysis sample.

Futhermore, the base **50-*a*** can be reused since it suffers little damage in use.

Figure 8:
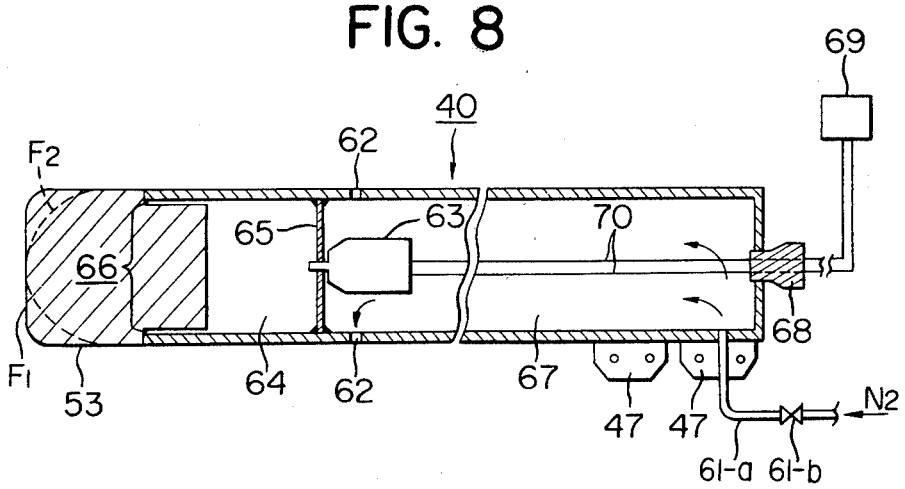
FIG. 8 is a partially sectional view of a pressure detecting lance used in the invention.

The lance 40 shown in FIG. 8 is provided with a gas retention chamber 64 having a gas inlet 66 at its forward end, a rearward cooling chamber 67 separated from the gas retention chamber 64 by a partition 65, and a closed rearward end. A lid 53 fits detachably into the gas inlet 66, and the rear end of the lid 53 is somewhat smaller than the inside diameter of the lance 40 while the forward end thereof has the same diameter as the outside diameter of the lance 40.

A pressure detector 63 is positioned in the cooling chamber 67 with its forward tip piercing through the center of the partition 65 to communicate with the gas retention chamber 64. A lead wire 70 from the pressure detector 63 passed through the cooling chamber 67, and then through a seal 68 at the rear of the lance 40 to a pressure indicator 69. $N_2$ gas is supplied to the cooling chamber 67 by opening a valve **61-*b* provided on a pipe 61-*a*. An $N_2$ gas exhaust outlet 62 is also provided. The lance 40 is connected via the bracket 47** to the lance carriage provided outside the furnace.

In the embodiment shown in FIG. **9-*a*, the pressure detector 63 is surrounded by a guide member 300 provided with single or plural throttle apertures 301 and is installed in the cooling chamber 67. $N_2$ gas which has passed through the cooling chamber 67 flows through the throttle apertures 301 of the guide member 300 to accelerate its flow speed to blow upon the pressure detector 63 in order to cool it. Finally, the $N_2$ gas escapes from the exhaust outlet 62 out of the lance 40. Thus, the pressure detector 63** is maintained in good order.

Measurement of the pressure in the blast furnace will now be described.

First, $N_2$ gas is introduced into the cooling chamber 67 of the lance 40 by opening the valve **61-*b* of the $N_2$ gas pipe 61-*a* so as to cool the lance 40. The $N_2$ gas used for cooling is discharged from the gas exhaust outlet 62. While the lance 40 is being cooled, the lance carriage 38 is driven to cause the forward tip of the lance 40 to enter the opening 9 provided in the wall of the shaft of the blast furnace. The lance 40** is driven gradually in the horizontal direction along the furnace diameter and through the layers of charge material.

At this time, since the forward end of the lid 53 is formed to have a flat head $F_1$ or hemispherical head $F_2$ as shown by the dotted line, the lance 40 can proceed straight ahead in the specified direction without being influenced by differences in the resistance offered by the layers of the charge material. Thus, as soon as the lance 40 reaches the predetermined position, the lance carriage 38 is stopped. The lance carriage 38 is then driven in the reverse direction to withdraw the lid 53 from the forward end of the lance 40 immediately beyond the position of measurement. Thereafter, the lance is retracted a little further and the lance carriage 38 is stopped when the forward end of the lance reaches the position where gas measurement is to be conducted in the blast furnace.

The furnace gas flows into the gas retention chamber 64 from the gas inlet 66 of the lance 40. The gas pressure in the gas retention chamber 64 is measured by a pressure detector 63 the tip of which pierces through the partition 65. The signal produced by the pressure detector 63 is transmitted outside the furnace via the lead wire 70 to the indicator 69 which displays the measured value.

In this case, since the lance 40 is horizontally inserted through the furnace wall, it is positioned at right angles to the flow direction of the furnace gas. Besides, as the furnace gas enters the gas retention chamber 64 through the gas inlet 66 at the forward end of the lance 40 and the gas inlet 66 is positioned at right angles to the gas flow of the furnace gas, the pressure shown by the indicator 69 is the static pressure.

When the measurement of the gas pressure is thus completed, the lance carriage 38 is again driven in the retreat direction to pull the lance 40 out of the furnace, and the valve **61-*b*** is closed simultaneously.

Figure 9:
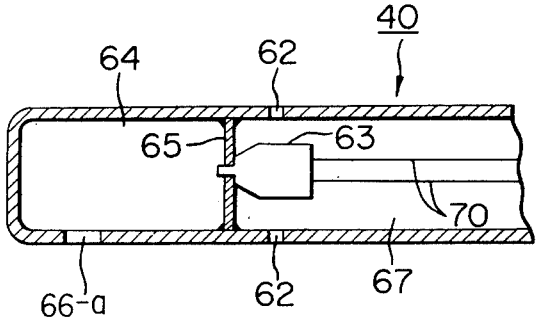
FIG. 9 and FIG. 9-*a* are sectional views of another embodiment different from that of FIG. 8.
Figure 9:
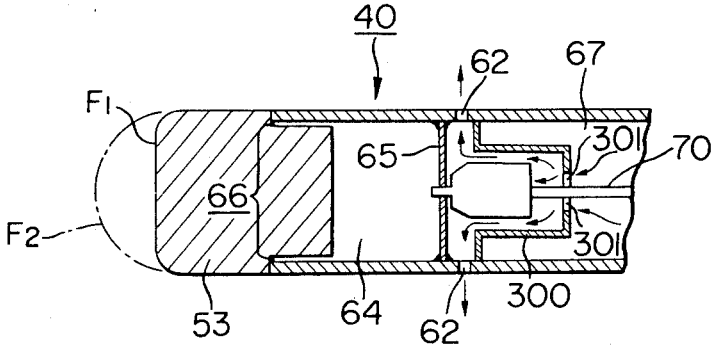

In the above embodiment, the measurement of the static pressure in the furnace was described, but the present invention is not limited to this type of measurement, but may, as shown in FIG. 9, by applied to measurement of the dynamic pressure by providing a gas inlet **66-*a* at the bottom of the gas retention chamber 64**.

In the foregoing, the use of lances for measuring the pressure of the furnace gas have been described. It should be noted, however, that other lances for measuring other factors such as the gas composition and gas temperature can be used. In such cases, the pressure detector 63 is replaced by a gas analyzer or a thermometer.

Next, a lance used for measuring the descent rate of the charge material in the blast furnace is described below.

Figure 10:
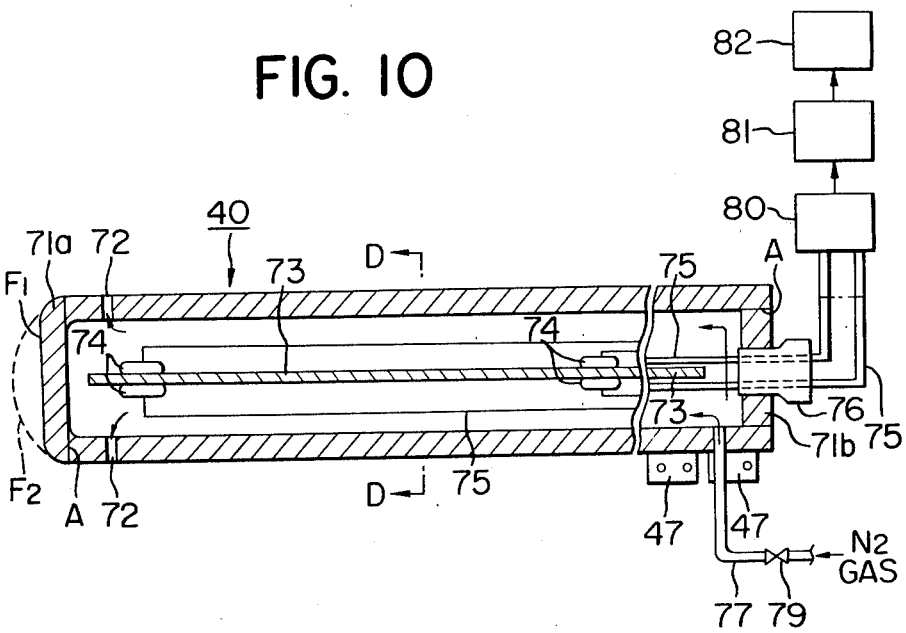
FIG. 10 is a sectional view of a lance used in the invention for detecting the descent rate of charge material.
Figure 11:
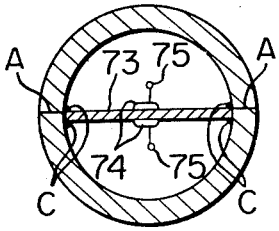
FIG. 11 is a sectional view along the line D—D of FIG. 10.

In FIG. 10, the lance 40 has lids **71*a* and 71*b* at its forward and rearward ends, respectively. Both lids are welded shut as shown at A. The lance, which is further provided with an $N_2$ gas exhaust outlet 72, is made of a steel pipe with the smallest bending stress that does not give rise to buckling at the time of insertion of the lance into the layers of the charge material in the blast furnace. The forward lid 71*a*** is formed with a flat head $F_1$ or a hemispherical head $F_2$ as shown by the dotted line so that it can easily proceed straight into the charge material layers.

On the inner circumference of the lance 40 is provided a flat bar 73 of steel sheet 1–2 mm thick secured thereto by welding A. There are also provided strain detectors 74 of resistance wire type secured one on each of the front and back surfaces of the flat bar 73 in the longitudinal direction.

The signal obtained from the strain detectors 74 is transmitted by a lead wire 75 through a seal 76 disposed in the rear lid 71*b* of the lance 40 to an indicator 82 via a calculator 80 and a converter 81.

The inside of the lance 40 is cooled by $N_2$ gas blown in through a tube 77 in order to maintain the ambient temperature of the strain detector 74 disposed on the flat bar 73 in the range of 200°–300° C. so as to prevent damage to the strain detector 74 and the occurrence of measurement error due to the heat.

To detect the descent rate of the charge material in the furnace by a lance inserted thereinto, first of all, the lance 40 is connected to the lance carriage 38 via the bracket 47, then the lance carriage 38 is driven forward while $N_2$ gas is blown into the lance through the tube 77 to cool the inside of the lance. While the lance is being cooled, it is inserted through the opening 9 in the shaft wall of the blast furnace into the layers of the charge material in the furnace in a horizontal state in the direction of the furnace diameter. Thus, when the forward tip of the lance 40 reaches the predetermined position, the lance carriage 38 is stopped to stop the insertion of the lance 40. The lance 40 is then left at this position for a while. The lance 40 is in a state where it is surrounded by the charge material in the furnace, and it is gradually bent downward as the charge material descends.

The flat bar 73 within the lance 40 bends together with the lance 40, and the amount of strain thus produced is detected by the strain detectors 74 fixed to the front and back of the flat bar 73. The detected value is introduced via the lead wire 75 to the calculator 80 installed outside the furnace to calculate the amount of strain per unit time. The calculator 80 outputs the value of its calculation to the second stage converter 81 used for the descent rate of the charge material to convert it to the descent rate of the charge material to be shown on the indicator 82.

Then, after measurement for a predetermined time (about 3–5 minutes), the lance carriage 38 is driven in the reverse direction to pull the lance 40 out of the furnace.

From the value shown by the indicator 82, both the descent rate of the charge material at every point and also the distribution of the descent rate of the charge material in the direction of the furnace diameter can be determined.

In the above embodiment of this invention, the measuring accuracy is enhanced by the provision of strain detectors 74 on the front and back of the flat bar 73, but it is understood that the present invention is not limited to the above embodiment. A strain detector provided on one side only also gives a degree of measurement accuracy free from any practical disadvantage.

Figure 12:
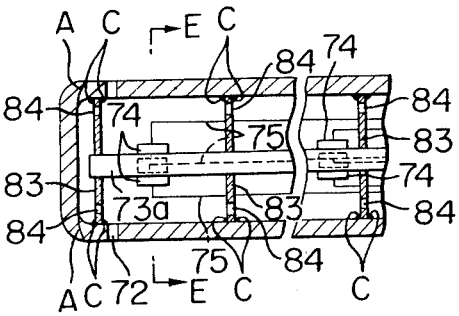
FIG. 12 is a partially sectional view of another embodiment different from that of FIG. 10.
Figure 13:
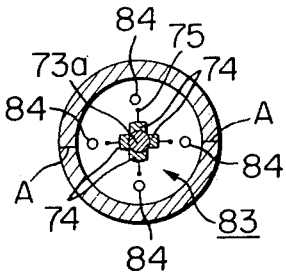
FIG. 13 is a sectional view along the line E—E of FIG. 12.

In the above embodiment, the flat bar 73 is used as a support member for the strain detectors, but other embodiments are also possible as shown in FIGS. 12 and 13. In these figures, a round bar 73*a* is used as a support member for the strain detector, and besides, the round bar 73*a* is held at plural places in the longitudinal direction of the lance 40 by a holding member 83 having a communication aperture for $N_2$ gas. The holding member 83 is preferably secured to the lance 40 by welding C. And furthermore, the round bar 73*a* is so provided with strain detectors on all sides, top and bottom, right and left, that the descent rate in any direction, not only the perpendicular, can be measured.

Although the present invention has been described in connection with the preferred embodiments, it is understood that changes and modifications may be resorted to without departing from the spirit of the invention. Such modifications are considered to be within the scope of the present invention as defined by the appended claims.

What is claimed is:

1. A sonde apparatus for a blast furnace comprising: a blast furnace gas cut-off valve, a tubular lance straightening means and a gas seal means provided in succession and in communication with one another on a straight support line extending outwardly from a tubular lance ingress and egress port means, said gas seal means preventing furnace gas counterflow from said furnace and disposed on a refractory wall of said blast furnace; a lance ingress and egress drive means also provided in succession on said straight support line; and a tubular lance for detecting and measuring at least one condition existing within said blast furnace; wherein said lance is removably carried by said ingress and egress drive means from said furnace.

2. A sonde apparatus as in claim 1, further comprising a tubular lance cooling means for cooling said tubular lance.

3. A sonde apparatus for a blast furnace as claimed in claims 1 or 2, wherein a tubular lance cutting means is installed next to said gas cut-off valve on said straight support line.

* * * * *